US006161946A

United States Patent [19]

Bishop et al.

[11] Patent Number: 6,161,946

[45] Date of Patent: Dec. 19, 2000

[54] LIGHT REFLECTOR

[76] Inventors: Christopher B. Bishop, 1216 E. Vista del Cerro, #1042, Tempe, Ariz. 85281; Douglas P. Bishop, 424 Wheatstone Dr., Billings, Mont. 59102

[21] Appl. No.: 09/189,046

[22] Filed: Nov. 9, 1998

[51] Int. Cl.[7] ..... F21V 7/08

[52] U.S. Cl. ..... 362/302; 362/294; 362/373

[58] Field of Search ..... 362/298, 299, 362/300, 302, 304, 285, 294, 373, 346

[56] References Cited

U.S. PATENT DOCUMENTS

| | | | |
|---|---|---|---|
| 254,578 | 3/1882 | Wheeler | 362/350 |
| 1,256,522 | 2/1918 | Croxton | 362/299 |
| 1,711,478 | 4/1929 | Halvorson, Jr. | 362/294 |
| 2,258,731 | 10/1941 | Blumenthal | 415/121.3 |
| 2,982,196 | 5/1961 | Sherron | 454/338 |
| 3,427,447 | 2/1969 | Clark | 362/299 |
| 3,601,597 | 8/1971 | Dunn | 353/61 |
| 3,691,365 | 9/1972 | Sequerra et al. | 362/6 |
| 3,695,009 | 10/1972 | Osteen | 96/147 |
| 3,770,338 | 11/1973 | Helmuth | 385/88 |
| 4,015,114 | 3/1977 | Paajanen et al. | 362/294 |
| 4,041,344 | 8/1977 | LaGiusa | 313/113 |
| 4,241,382 | 12/1980 | Daniel | 362/581 |
| 4,298,911 | 11/1981 | Headrick | 362/35 |
| 4,405,974 | 9/1983 | Quiogue | 362/362 |
| 4,423,471 | 12/1983 | Gordin et al. | 362/96 |
| 4,439,816 | 3/1984 | Litchfield | 362/96 |
| 4,546,420 | 10/1985 | Wheeler et al. | 362/268 |
| 4,701,833 | 10/1987 | Bornhorst | 362/294 |
| 4,711,161 | 12/1987 | Swin, Sr. et al. | 454/230 |
| 4,800,467 | 1/1989 | Lindae et al. | 362/539 |
| 4,849,862 | 7/1989 | Diskin et al. | 362/96 |
| 4,868,369 | 9/1989 | Chen | 219/242 |
| 4,899,261 | 2/1990 | Blusseau et al. | 362/521 |
| 4,926,293 | 5/1990 | Saba | 362/96 |
| 4,947,305 | 8/1990 | Gunter, Jr. | 362/297 |
| 4,956,759 | 9/1990 | Goldenberg et al. | 362/297 |
| 5,143,447 | 9/1992 | Bertenshaw | 362/297 |
| 5,235,499 | 8/1993 | Bertenshaw | 362/297 |
| 5,268,613 | 12/1993 | Cunningham | 313/113 |
| 5,270,751 | 12/1993 | Christian | 353/7 |
| 5,345,371 | 9/1994 | Cunningham et al. | 362/297 |
| 5,422,795 | 6/1995 | Liu | 362/96 |
| 5,443,625 | 8/1995 | Schaffhausen | 95/113 |
| 5,446,637 | 8/1995 | Cunningham et al. | 362/321 |
| 5,544,029 | 8/1996 | Cunningham | 362/293 |
| 5,580,164 | 12/1996 | Maddox et al. | 362/293 |
| 5,613,767 | 3/1997 | Hamanaka | 362/298 |
| 5,626,416 | 5/1997 | Romano et al. | 362/264 |
| 5,636,917 | 6/1997 | Furami et al. | 362/538 |
| 5,692,821 | 12/1997 | Rodriguez, Jr. et al. | 353/52 |
| 5,695,277 | 12/1997 | Kim | 362/299 |
| 5,758,955 | 6/1998 | Belliveau | 362/293 |
| 5,791,755 | 8/1998 | Henry et al. | 353/120 |
| 6,004,010 | 12/1999 | Inage | 362/294 |

*Primary Examiner*—Alan Cariaso
*Assistant Examiner*—Hargobind S. Sawhney
*Attorney, Agent, or Firm*—Schmeiser, Olsen & Watts

[57] ABSTRACT

A light reflector imaging a high-intensity light beam includes a reflector part shaped as a portion of an ellipsoid, and a reflector part with two parallel edges, shaped as the zone of a sphere. The smaller parallel edge of the spherical reflector part serves as an aperture. The ellipsoidal reflector part has a rectangular opening offset slightly in one direction from its axis of revolution, and large enough to receive a socket. The ellipsoidal reflector part connects to the larger parallel edge of the spherical reflector part to enclose a lamp. A curvilinear reflector part can be attached to the aperture of the spherical reflector part to more narrowly focus the light exiting from the disclosed light reflector. The curvilinear reflector part is a paraboloidal-like shaped tube, which varies in curve and length according to a desired output angle. Other attachments to the two-part reflector assembly include a thin cylindrical tube into which a glass piece is mounted to cover the aperture. Alternatively, the thin tube can house a collimating lens to further focus exiting light. The majority of light shining from the lamp enclosed by the light reflector takes one of three paths. First, light shining towards the aperture of the light reflector exits directly. Second, light shining towards the spherical reflector part is reflected towards the ellipsoidal reflector part. Third, light shining towards the ellipsoidal reflector part is reflected towards a focal point beyond the aperture, exiting the light reflector through the aperture.

16 Claims, 4 Drawing Sheets

LIGHT REFLECTOR

BACKGROUND OF THE INVENTION

1. Technical Field

This invention generally relates to light reflectors, and more specifically relates to a light reflector that images a high-intensity light beam at a distant location.

2. Background Art

Light reflectors have long been used to bounce light off of a reflective surface. Light generally shines in all directions from a light source. However, if light shining in all directions from a light source is not useful, a reflective surface can be employed to reflect light from a direction in which it is not useful and projected towards a direction in which the light is useful. In this way, light reflectors increase the amount of light shining in a desired direction.

Various conventional devices relate to light reflectors. Examples of patents pertinent to the present invention include:

- U.S. Pat. No. 5,695,277 to Kim for a light source apparatus for generating parallel light having dual mirrors for eliminating lamp shadow effects;
- U.S. Pat. No. 5,636,917 to Furami et al. for a projector type head light;
- U.S. Pat. No. 5,544,029 to Cunningham for a lighting fixture for theater, television and architectural applications;
- U.S. Pat. No. 5,446,637 to Cunningham et al. for a lighting fixture;
- U.S. Pat. No. 5,345,371 to Cunningham et al. for a lighting fixture;
- U.S. Pat. No. 5,268,613 to Cunningham for an incandescent illumination system;
- U.S. Pat. No. 5,235,499 to Bertenshaw for a lamp system having a toroidal light emitting member;
- U.S. Pat. No. 5,143,447 to Bertenshaw for a lamp system having a toroidal light emitting member;
- U.S. Pat. No. 4,956,759 to Goldenberg et al. for an illumination system for non-imaging reflective collector;
- U.S. Pat. No. 4,947,305 to Gunter, Jr. for a lamp reflector;
- U.S. Pat. No. 4,899,261 to Blusseau et al. for an automobile headlamp with small height and high flux recovery;
- U.S. Pat. No. 4,800,467 to Lindae et al. for a dimmed headlight, particularly for motor vehicles;
- U.S. Pat. No. 4,241,382 to Daniel for a fiber optics illuminator;
- U.S. Pat. No. 4,041,344 to LaGiusa for an ellipsoidal reflector lamp;
- U.S. Pat. No. 3,770,338 to Helmuth for a fiber optics light source;
- U.S. Pat. No. 1,711,478 to Halvorson, Jr. for a light reflector; and
- U.S. Pat. No. 254,578 to Wheeler for a reflector;

each of which is herein incorporated by reference for its pertinent and supportive teachings.

Problems exist among the aforementioned patent references. Typically, despite the use of reflectors, an excessive amount of light emitted by a light source is not projected in the desired direction. Instead, light becomes misdirected and absorbed by the non-reflective components in a light fixture. The misdirected light wastes electrical energy and leads to the undesired heating of the light fixture components. In many instances, the components of a light fixture become warped by the excessive heat, and therefore must be replaced.

Problems due to excessive heat have partially been solved by incorporating a fan into the light fixtures. Typically, a fan draws air across a surface of the hot light fixture components. The use of fans is only a partial solution, however, for reflector lights which operate in environments polluted with dust, pollen, oils, and other particulate and vaporous matter. In that case, the polluted air enters into and deposits onto light fixture equipment. Cleaning of these deposits must occur regularly to prevent damage to sensitive equipment parts as well as to maintain peak performance of the equipment. Such cleaning problems are expensive to remedy, requiring many hours of labor to correct. During cleaning, the equipment is inoperable which results in a loss in productivity.

Another problem exists when the reflective components of a light fixture include lenses, which are used to shape the projected light beam. Lenses themselves contribute to misdirected and absorbed light. Additionally, lenses make up a significant portion of the weight and cost of a light fixture, and are subject to breakage.

Still another problem is that the projected light can sometimes have an intensity varying radially such that a concentric light pattern is projected. The undesired concentric ring pattern occurs because of variations in the shape of the bulb. In addition, the filament in the lamp appears as an image. Attempts to eliminate the filament shadow and concentric ring pattern have resulted in an increased amount of misdirected light.

A further problem is that light fixtures with reflective components typically emit an undesired amount of infrared light along with the desired visible light. This infrared light unduly heats the area on which the projected light is imaged, which is undesirable for light fixtures used in theater, television, and architectural applications. The reflection of undesired infrared light leads to further heating of the light fixture components.

Thus, there is a need to provide a light reflector which reduces misdirected and absorbed light. There is also a need to provide a light reflector which can shape a projected light beam without requiring the use of lenses. Further, there is a need to provide a light reflector which can minimize the concentric ring pattern. And, there is a need to provide a light reflector which does not unduly transmit infrared light. Finally, there is a need to protect light fixture equipment from heat damage as well as the pollution deposits caused by circulating polluted air through the equipment as a means to dissipate heat. These, and other identified needs, are satisfied by the present invention.

DISCLOSURE OF INVENTION

According to the present invention, a light reflector imaging a high-intensity light beam is disclosed. The light reflector includes a reflector part shaped as a portion of an ellipsoid, and a reflector part with two parallel edges, shaped as the zone of a sphere. The smaller parallel edge of the spherical reflector part serves as an aperture to allow a high-intensity light beam to exit the light reflector. The ellipsoidal reflector part has a rectangular opening offset slightly in one direction from its axis of revolution, and large enough to receive a socket. The ellipsoidal reflector part connects to the larger parallel edge of the spherical reflector part to enclose a bulb.

The majority of light shining from the lamp enclosed by the light reflector takes one of three paths. First, light shining towards the aperture of the light reflector exits directly. Second, light shining towards the spherical reflector part is reflected towards the ellipsoidal reflector part. Third, light shining towards the ellipsoidal reflector part is reflected towards a focal point beyond the aperture, exiting the light reflector through the aperture.

A curvilinear reflector part can be attached to the aperture of the spherical reflector part to more narrowly focus the light exiting from the disclosed light reflector. The curvilinear reflector part is a paraboloidal-like shaped tube, which varies in curve and length according to a desired output angle. Other attachments to the two-part reflector assembly include a thin cylindrical tube into which a glass piece is mounted to cover the aperture. Alternatively, the thin tube can house a collimating lens to further focus exiting light. The foregoing and other features and advantages of the invention will be apparent from the following more particular description of preferred embodiments of the invention, as illustrated in the accompanying drawings.

BRIEF DESCRIPTION OF DRAWINGS

The preferred embodiments of the present invention will hereinafter be described in conjunction with the appended drawings, where like designations denote like elements, and.

BEST MODE FOR CARRYING OUT THE INVENTION

The disclosed light reflector is designed to enclose a lamp and to emit a high-intensity beam through its aperture. The present invention is suitable for applications involving light fixtures, such as studio and stage lights, as well as for applications involving portable lamps, such as flashlights and the lights on miners' helmets. In any application of the present invention, substantially all light leaving the lamp enclosed by the disclosed light reflector is either directly output through the aperture, or indirectly output through the aperture after being reflected one or two times.

Figure 1:
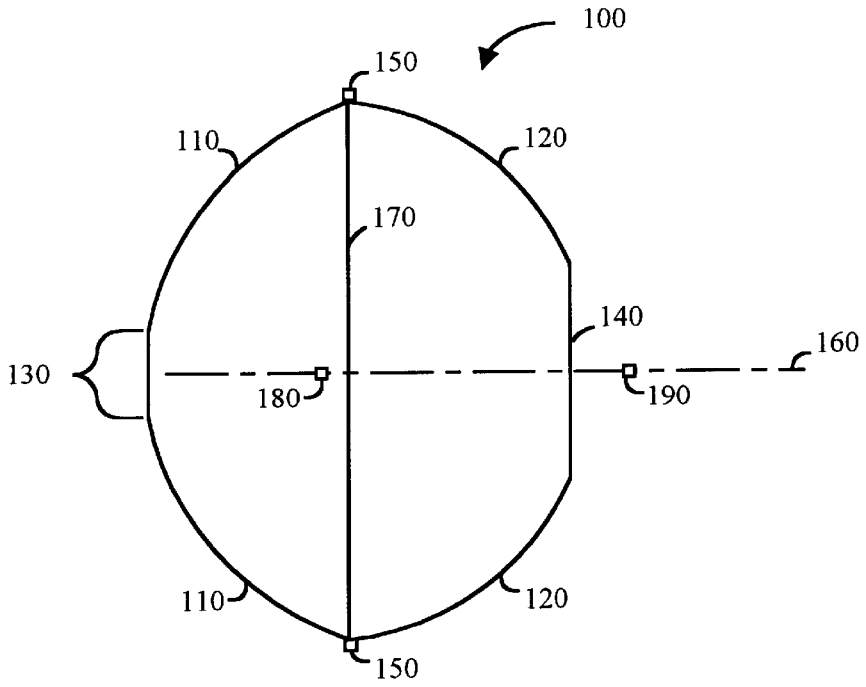
FIG. 1 is a side view of a two-part light reflector according to a preferred embodiment of the present invention.

Referring now to FIG. 1, a side view 100 of a two-part light reflector according to a preferred embodiment of the present invention is illustrated. Side view 100 illustrates the light reflector design for both light fixtures and for portable applications of the present invention. Reflector part 110 is shaped as a portion of an ellipsoid, which has two foci, first focus 180 and second focus 190 along axis of revolution 160. Rectangular opening 130 is located slightly off of the axis of revolution 160. The offset is perpendicular to side view 100, and is therefore not visible in FIG. 1. Rectangular opening 130 serves to receive a light socket. Rectangular opening 130 is preferably sized slightly wider and longer than the dimensions of the socket such that minor adjustments can be made in the socket positioning within rectangular opening 130.

Reflector part 120 is shaped as the zone of a sphere, containing smaller parallel edge 140 and larger parallel edge 170. Smaller parallel edge 140 serves as an aperture to allow light to exit the disclosed light reflector. First focus 180 of ellipsoidal reflector part 110 is also the spherical center of reflector part 120. Connection means 150 attaches ellipsoidal reflector part 110 to larger parallel planar edge 170. In this manner ellipsoidal reflector part 110 joins with spherical reflector part 120 to enclose a lamp. Connection means 150 is preferably a mounting flange, but those skilled in the art will recognize that connection means 150 can be any suitable means to connect ellipsoidal reflector part 110 to spherical reflector part 120.

Figure 2:
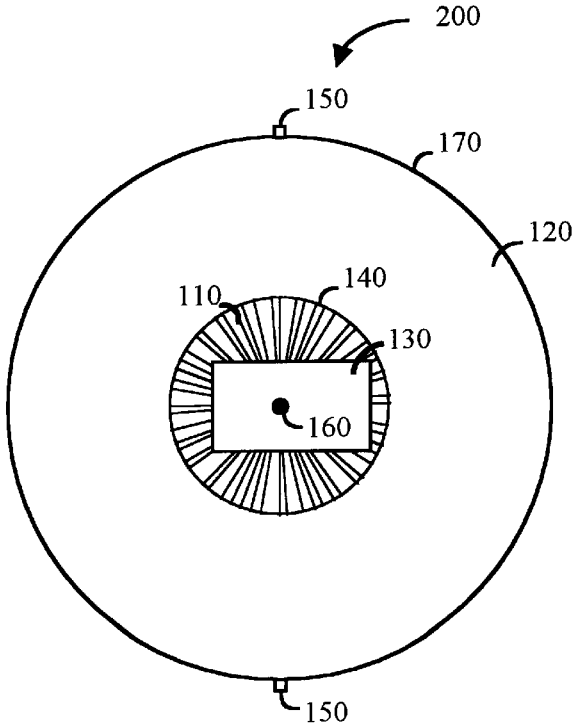
FIG. 2 is a front view of a two-part light reflector according to a preferred embodiment of the present invention.

Referring now to FIG. 2, a front view 200 of a two-part light reflector according to a preferred embodiment of the present invention is illustrated. Front view 200 again illustrates the basic light reflector design for both fixed and portable applications of the present invention. Looking through aperture 140 into the inside of the connected two-part light reflector, offset rectangular opening 130 in ellipsoidal reflector part 110 is visible at the rear of the two-part light reflector. Rectangular opening 130 is preferably offset from rotational axis 160 such that when it receives a light socket, only minor adjustments need be made to align one edge of the lamp filament with rotational axis 160.

The inside surface of ellipsoidal reflector part 110 is preferably divided into small trapezoidal facets that are curved in one or two dimensions. The facets vary radially as well as circumferentially. The facets are preferably coated with multiple thin-film layers of different dielectric materials, which trap heat. The coating provides a substantially higher reflectance at visible wavelengths than at infrared wavelengths. The coating thus minimizes the amount of reflected infrared light, which minimizes undesired heating of the components of the disclosed light reflector.

Figure 3:
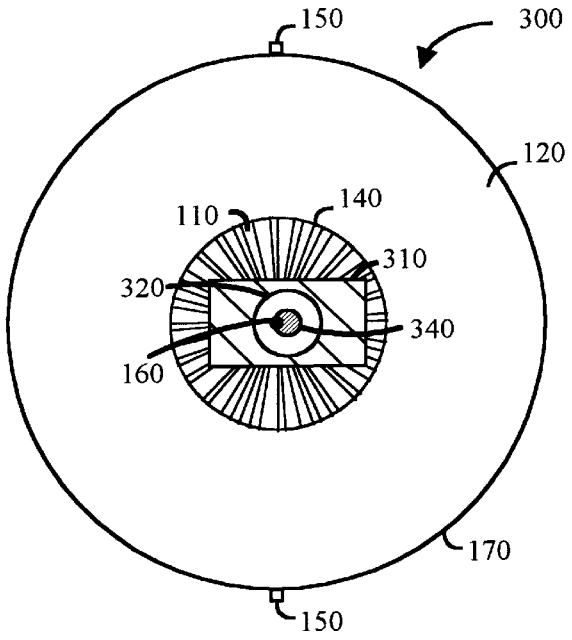
FIG. 3 is a front view of a two-part light reflector enclosing a lamp according to a preferred embodiment of the present invention.

Referring now to FIG. 3, a front view 300 of a two-part light reflector enclosing a lamp according to a preferred embodiment of the present invention is illustrated. Socket 310 is inserted into the offset rectangular opening in ellipsoidal reflector part 110. The rectangular opening is preferably larger than socket 310 to allow minor adjustments to be made in the positioning of socket 310 within the rectangular opening. The difference in size and positioning of socket 310 within the rectangular opening are not shown in FIG. 3.

Socket 310 receives the lamp containing cylindrical bulb 320, which in turn contains helical filament 340. Because of the offset location of the rectangular opening, and because the rectangular opening is suitably wider and longer than socket 310, socket 310 can be positioned slightly off-center of rotational axis 160. Specifically, socket 310 can be positioned such that one edge of helical filament 340 is preferably aligned with rotational axis 160. This positioning prevents most of the light striking spherical reflector part 120 from bouncing back on and being absorbed by filament 320. Reabsorption of light by filament 340 causes heating which shortens the life span of cylindrical bulb 320.

Further, minor adjustments in the positioning of socket 310 within the rectangular opening enable variations in the amount of light which strikes filament 340. Generally, where there is a greater offset of filament 340 from rotational axis 160, less light will strike filament 340. However, a greater offset skews the light beam exiting from aperture 140, because the greater offset reduces beam symmetry. Therefore, depending on the application of the light fixture, and the desirability and need for a symmetrical beam, the positioning of socket 310 may be varied within the rectangular opening in ellipsoidal reflector part 110.

Figure 4:
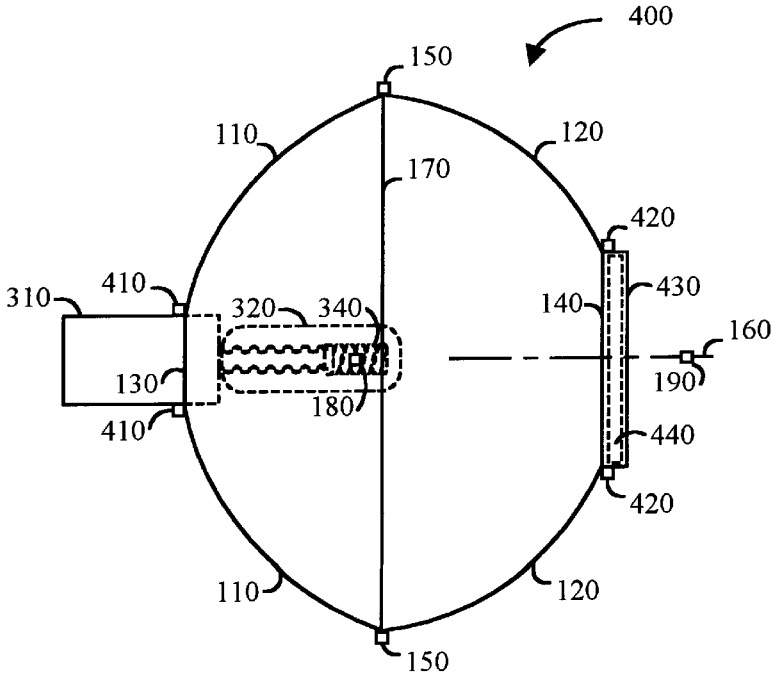
FIG. 4 is a side view of a two-part light reflector enclosing a lamp according to a preferred embodiment of the present invention.

Referring now to FIG. 4, a side view 400 of a two-part light reflector enclosing a lamp according to a preferred embodiment of the present invention is illustrated. Socket 310 is offset from rotational axis 160 such that the edge of helical filament 340 is aligned with first focus 180 of ellipsoidal reflector part 110. However the offset of these components is perpendicular to side view 400, and therefore not shown by FIG. 4. Helical filament 340 is preferably a wire that has been coiled very tightly, and the coiled wire is further coiled into a large helix. Cylindrical bulb 320 is preferably a bulb in a standard lamp, such as the lamps known by their ANSI designation as FEL, or FLK. Socket 310 is preferably a standard socket designed for a standard lamp. Because the disclosed light reflector uses such standard components, it is inexpensive to produce.

Thin cylindrical tube 430 has a radius to match aperture 140 and a length such that substantially no light rays reflected from ellipsoidal reflector part 110 will strike cylindrical tube 430. Cylindrical tube 430 receives glass cover 440. Glass cover 440 may merely be a light fixture cover to comply with UL 1573, "Stage and Studio Lighting Units," which requires that cylindrical bulb 320 generally not be accessible through any opening larger than one-eighth of an inch diameter. The addition of glass cover 440 seals aperture 140 to prevent such access.

Glass cover 440 may also be a collimating lens to redirect light exiting from aperture 140; however, collimating lenses are not needed to support the disclosed light reflector. Nor are collimating lenses desirable, since the lenses themselves contribute to misdirected and absorbed light. Thin cylindrical tube 430 may also allow the operation of various accessories including but not limited to an iris, shutters, dichroic glass for the purpose of coloring the light, and rotating and fixed templates (stencils used with theatrical lights).

Alternatively, glass cover 440 may operate as a heat shield, or as an ultraviolet radiation filter if the lamp used with the two-part light reflector is of the gas-discharge type Glass cover 440 can greatly suppress infrared light if it is covered with multiple thin-film layers of different dielectric materials. The resulting coated glass cover contains a substantially higher transmittance at visible wavelengths than at infrared wavelengths. In this manner, glass cover 440 can increase the longevity of the accessories housed by cylindrical tube 430 and increase the comfort of those in the beam of focused light.

Socket 310 is connected to ellipsoidal reflector part 110 by connection means 410. Thin cylindrical tube 430 is connected to spherical reflector part 120 by connections means 420. Connection means 410 and 420 are preferably mounting flanges, but those skilled in the art will recognize that connection means 410 can be any suitable means for connecting socket 310 to ellipsoidal reflector part 110, and connection means 420 can be any suitable means for connecting thin cylindrical tube 430 to spherical reflector part 120.

The two-part light reflector is designed so that most of the light leaving filament 340 and cylindrical bulb 320 will follow one of three paths. First, light can exit directly through aperture 140. Second, light can strike ellipsoidal reflector part 110 and bounce back through aperture 140 towards second focus 190. Third, light can strike spherical reflector part 120, bounce back through spherical center 180 towards ellipsoidal reflector part 110, strike ellipsoidal reflector part 110, and bounce back again through aperture 140 towards second focus 190. Although the disclosed light reflector is designed to maximize the amount of light shining through aperture 140, not all the light leaving filament 340 will follow one of these three paths. For instance, any light that reflects directly on filament 340, or on socket 310 will be scattered.

The purpose of ellipsoidal reflector part 110 is to reflect light from first focus 180 through aperture 140 towards second focus 190. Helical filament 340 is positioned such that first focus 180 is halfway along the length of filament 340, and such that first focus 180 is offset from the rotational center of filament 340, instead being aligned with the edge of filament 340. The offset from the rotational center of filament 340 is perpendicular to side view 400, and is therefore not shown in FIG. 4. Light shining from filament 340 that hits ellipsoidal reflector part 110 is reflected to second focal point 190.

The purpose of spherical reflector part 120 is to bounce light through spherical center 180 and towards ellipsoidal reflector part 110. Because filament 340 is offset from spherical center 180, most of the light aimed at spherical center 180 is not absorbed by filament 340. In this manner the methods of the present invention avoid unnecessary heating of filament 340 and its associated components.

Figure 5:
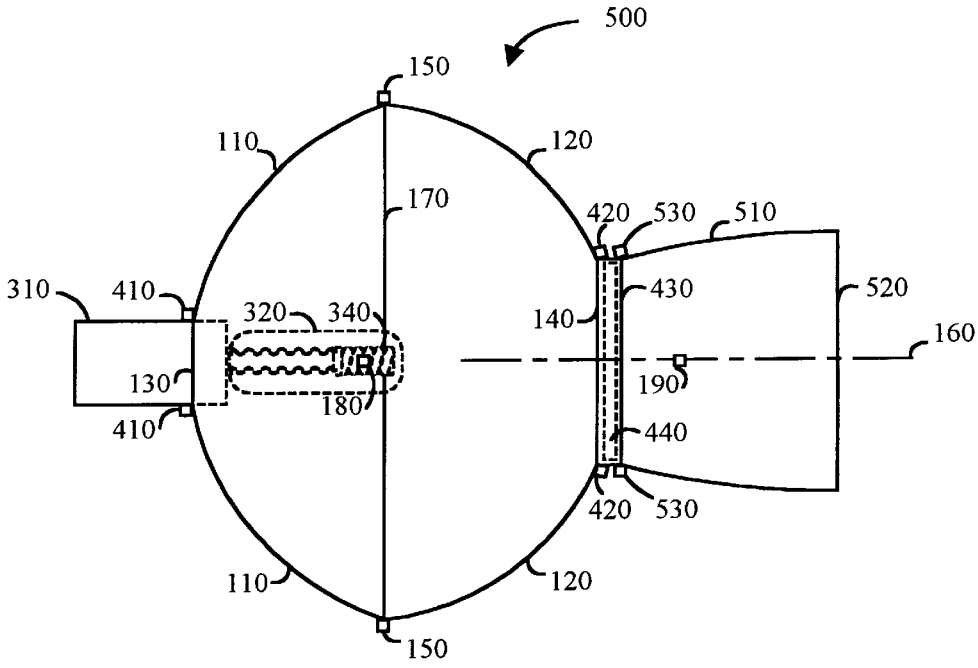
FIG. 5 is a side view of a three-part light reflector enclosing a lamp according to a preferred embodiment of the present invention.

Referring now to FIG. 5, a side view 500 of a three-part light reflector with an enclosed lamp according to a preferred embodiment of the present invention is illustrated. Curvilinear reflector part 510 is designed to focus the light exiting from aperture 140. Curvilinear reflector part 510 is shaped according to the following equation:

$$\frac{\partial z}{\partial r} = \frac{1}{ar^2 + br + c}$$

where z is the position of curvilinear reflector part 510 along axis of rotation 160;

r is the radial position of curvilinear reflector part 510 (perpendicular to axis of rotation 160); and a, b, c are parameters of the curve fit.

The following tables present information for the design of curvilinear reflector part 510. Table 1 presents input parameters for a preferred embodiment of the two-part light reflector to which the curvilinear reflector part attaches.

| Input Parameter | Value (inches) |
|---|---|
| Two-part Light Reflector Width | 6.000 |
| Radius of Filament 340 | 0.250 |
| Radius of Outer Bulb 320 | 0.375 |
| Offset of Filament 340 from Rotational Axis 160 | −0.125 |
| Length of Filament 340 | 0.600 |
| Length of Bulb 320 | 2.000 |
| Half-length of Rectangular Opening 130 | 0.875 |
| Half-width of Rectangular Opening 130 | 0.500 |

Based on the preferred dimensions of the disclosed two-part light reflector as detailed in Table 1, and the desired maximum output angle of light exiting aperture 520, values for parameters a, b, and c can be determined. Table 2 lists values for parameters a, b, and c corresponding to a wide range of desired output angles.

| Output Angle (degrees) | a ($in^{-2}$) | b ($in^{-1}$) | c (unitless) | Aperture Radius (inches) | Front Reflector Length (inches) | Fixture Length (inches) |
|---|---|---|---|---|---|---|
| 20 | −0.025317 | −0.0088442 | 0.416882 | 3.776 | 17.50 | 23.219 |
| 25 | −0.049400 | 0.054408 | 0.344338 | 3.192 | 15.25 | 20.969 |
| 30 | −0.105544 | 0.221901 | 0.199767 | 2.732 | 11.00 | 16.719 |
| 35 | −0.183379 | 0.437425 | 0.022898 | 2.411 | 9.75 | 15.469 |
| 40 | −0.330052 | 0.849149 | −0.287570 | 2.150 | 7.75 | 13.469 |
| 45 | −0.546775 | 1.432519 | −0.698499 | 1.952 | 6.00 | 11.719 |
| 50 | −0.852076 | 2.218798 | −1.226071 | 1.791 | 5.00 | 10.719 |
| 55 | −1.268535 | 3.257450 | −1.891267 | 1.664 | 4.00 | 9.719 |
| 60 | −1.811196 | 4.578180 | −2.712182 | 1.560 | 3.25 | 8.969 |
| 65 | −2.700757 | 6.752425 | −4.073104 | 1.480 | 3.00 | 8.719 |
| 70 | −4.017416 | 9.935142 | −6.008975 | 1.407 | 2.50 | 8.219 |
| 75 | −10.44534 | 17.18495 | −6.995059 | 1.343 | 2.00 | 7.719 |
| 80 | −12.98513 | 31.63250 | −19.18242 | 1.293 | 1.75 | 7.469 |
| 85 | −27.449679 | 66.55753 | −40.28531 | 1.256 | 1.25 | 6.969 |

Curvilinear reflector part 510 can be used in conjunction with any type of light assembly. For instance, curvilinear reflector part 510 can be used in conjunction with a light reflector of a different shape than the disclosed two-part light reflector which partially encloses a light source such as cylindrical bulb 320. Alternatively, curvilinear reflector part 510 can be attached to the aperture of any other type of light assembly to shape the light exiting from the aperture. Those skilled in the art will understand that although the input design parameters will vary, the curvilinear reflector part equation can still function to calculate the length and shape of curvilinear reflector part 510.

Figure 6:
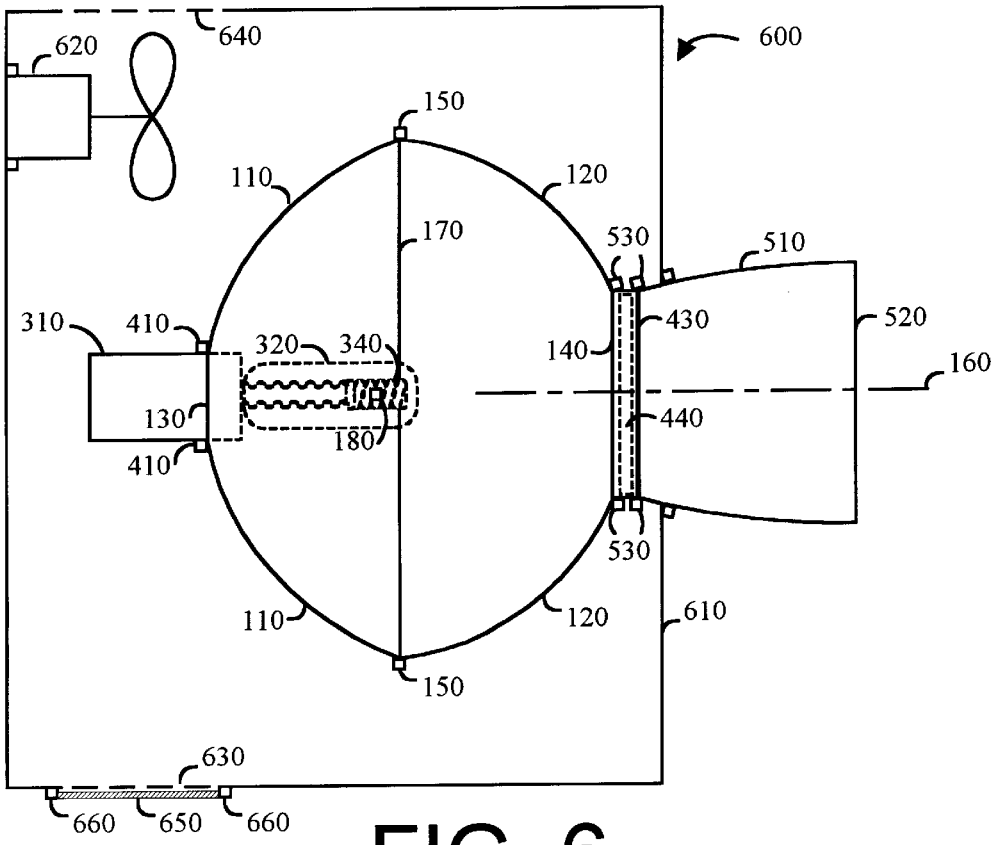
FIG. 6 is a side view of a three-part light reflector enclosed in a housing according to a preferred embodiment of the present invention.

Referring now to FIG. 6, a side view 600 of a three-part light reflector enclosed in a light housing according to a preferred embodiment of the present invention is illustrated. Housing 610 encloses the three-part light reflector and the components that make it function (although not all components are shown in side view 600). Housing 610 preferably encloses the light reflector in light fixture applications such as stage and studio lighting. Fan 620 serves to help keep the components of the light reflector, such as ellipsoidal reflector part 110, from overheating. Ellipsoidal reflector part 110 tends to absorb heat, since it is preferably coated with multiple thin-film layers of different dielectric materials. Fan 620 preferably sucks air into housing 610 through intake vent 630, across the light reflector components including ellipsoidal reflector part 110, and back out of housing 610 through outflow vent 640.

Because air sucked into housing 610 may be polluted with dust, pollen, oils, and other particulate and vaporous matter, filter 650 is attached to intake vent 630 by connection means 660. Filter 650 traps pollutants and prevents their deposit on components of the light reflector. Filter 650 is preferably standard filter material impregnated with active charcoal, which performs the filtering action. Filter 650 allows fan 620 to prevent the problem of heat damage to the components of the light reflector. Further, filter 620 supports heat dissipation while reducing the frequency of regular cleaning of pollutants off the components of the light reflector. Connection means 660 is preferably Velcro®, a frame, or some other means of fastening filter 650 to intake vent 630 or housing 610. It should be noted that filter 650 can be used with the two-part light reflector illustrated in FIG. 4 as well as the three part light reflector illustrated in FIG. 6.

The foregoing discussion described a preferred embodiment of the disclosed light reflector as it applies to a stationary light fixture, such as a stage or studio light. The ellipsoidal reflector part contains a rectangular opening into which a socket may be inserted. An alternate embodiment of the light reflector does not contain any opening in the ellipsoidal reflector part. As a result, a different means is used to enclose a lamp. This alteration in the design is preferred for portable reflector lamps, such as a flashlight, or the light on a miners' helmet.

Figure 7:
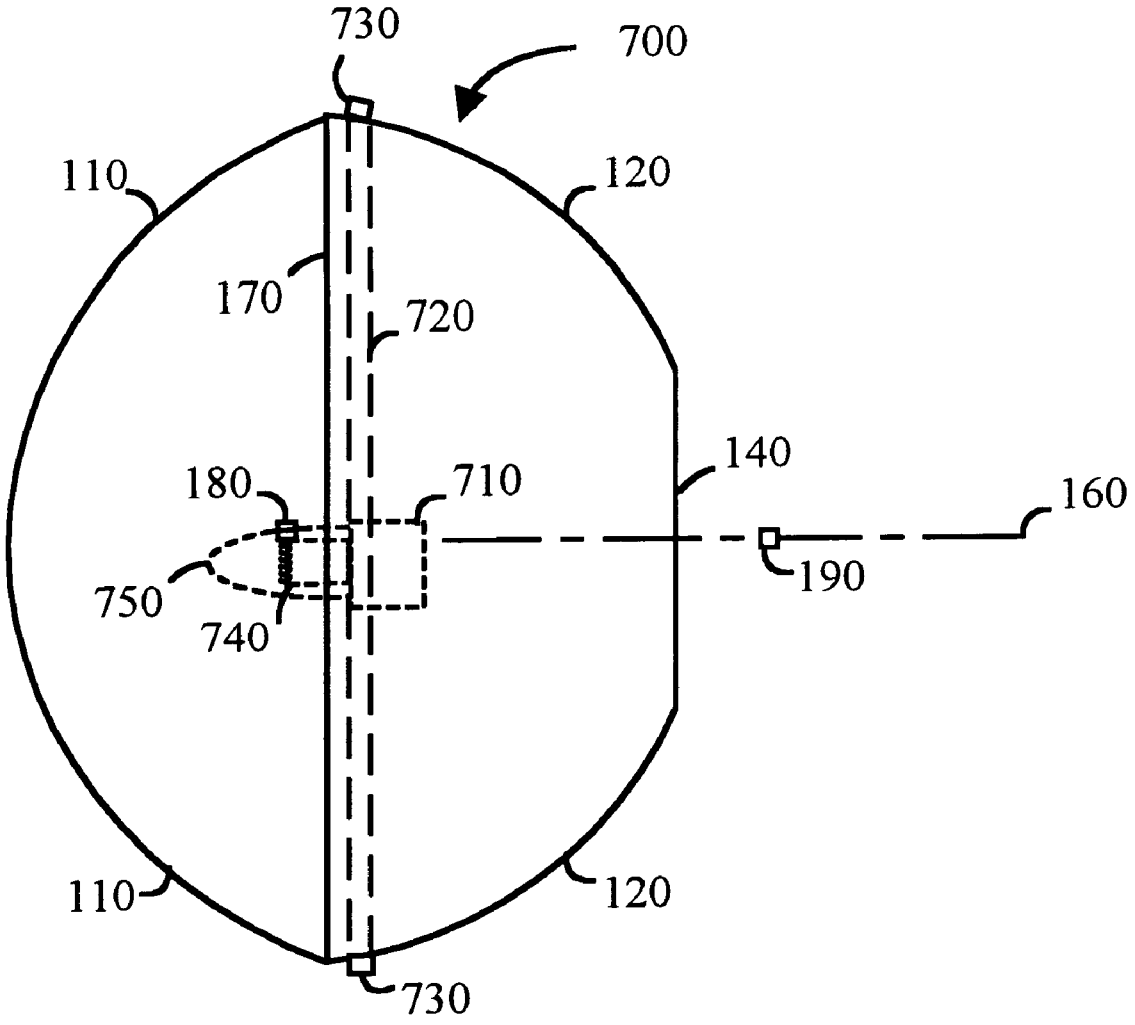
FIG. 7 is a top view of a two-part light reflector enclosing a flashlight bulb according to a preferred embodiment of the present invention.

Referring now to FIG. 7, a top view 700 of a two-part light reflector for a flashlight according to a preferred embodiment of the present invention is illustrated. Socket 710 is attached to thin strip 720, which runs between the sides of the disclosed light reflector. Thin strip 720 is connected to the sides of ellipsoidal reflector part 110 and spherical reflector part 120 by connection means 730. Connection means 730 is preferably a mounting flange, but those skilled in the art will recognize that connection means 730 can be any suitable means for connecting thin strip 720 to the two-part reflector assembly.

The direction of socket 710, flashlight bulb 750, and filament 740 are reversed to face towards ellipsoidal reflector part 110, instead of towards aperture 140. Socket 710 is slightly off center from rotational axis 160. Socket 710 receives flashlight bulb 750 and filament 740. First focus 180 is half-way along the length of and at one edge of filament 740. First focus 180 is also the spherical center of spherical reflector part 120. Filament 740 is preferably a coiled wire between two posts. One end of filament 740 is preferably aligned with first focus 180. Because the center of filament 740 is not exactly aligned with first focus 180, light shining towards spherical reflector part 120 is not reflected directly back at filament 740. In this manner, filament 740 does not unnecessarily overheat.

While the invention has been particularly shown and described with reference to preferred embodiments thereof, it will be understood by those skilled in the art that various changes in form and details may be made therein without departing from the spirit and scope of the invention.

What is claimed is:

1. An apparatus comprising:

an ellipsoidal reflector part shaped as a portion of an ellipsoid having a first focus and a second focus;

a spherical reflector part shaped as a zone of a sphere having a larger parallel edge and a smaller parallel edge, said smaller edge serving as an aperture, and said larger parallel edge connected to said ellipsoidal reflector part such that the spherical center of said spherical reflector part is also said first focus of said ellipsoidal reflector part;

a socket inserted into a rectangular opening in said ellipsoidal reflector part, said rectangular opening slightly offset in one direction from the axis of revolution of said ellipsoidal reflector part; and a lamp inserted into said socket, said lamp comprising a cylindrical bulb and a helical filament, wherein said socket and said lamp are positioned in said slightly offset rectangular opening such that said first focus is located halfway along the length of said filament and at the perimeter of said helical filament.

2. The apparatus of claim 1 wherein the inside of said ellipsoidal reflector part is divided circumferentially and radially into small trapezoidal facets that are curved.

3. The apparatus of claim 1 wherein the inside of said ellipsoidal reflector part is coated with multiple thin-film layers of different dielectric materials.

4. The apparatus of claim 1 further comprising a housing, said housing including an intake vent and an outflow vent, and said housing enclosing said ellipsoidal reflector part, and said spherical reflector part.

5. The apparatus of claim 4 further comprising:

a filter covering said intake vent; and a fan, said fan sucking air into said housing through said filter and said intake vent, and across said ellipsoidal reflector part.

6. The apparatus of claim 1 further comprising a curvilinear reflector part, said curvilinear reflector part attached to said smaller parallel edge of said spherical reflector part, said curvilinear reflector part shaped to limit the output angle of light exiting from said aperture.

7. The apparatus of claim 6 wherein the inside of said curvilinear reflector part is coated with multiple thin-film layers of different dielectric materials.

8. The apparatus of claim 1 further comprising a cylindrical tube, said cylindrical tube attached to said smaller parallel edge of said spherical reflector part.

9. The apparatus of claim 8 further comprising a curvilinear reflector part attached to said cylindrical tube, said curvilinear reflector part shaped to limit the output angle of light exiting from said aperture.

10. The apparatus of claim 8 wherein said cylindrical tube houses a glass cover for said aperture.

11. The apparatus of claim 10 wherein said glass cover is a collimating lens.

12. An apparatus comprising:

an ellipsoidal reflector part shaped as a portion of an ellipsoid having a first focus and a second focus;

a spherical reflector part shaped as a zone of a sphere having a larger parallel edge and a smaller parallel edge, said smaller dege serving as an aperture, and said larger parallel edge connected to said ellipsoidal reflector part such that the spherical center of said spherical reflector part is also said first focus of said ellipsoidal reflector part;

a thin strip running perpendicular to the rotational axis of said spherical reflector part;

a socket attached to said thin strip;

a flashlight bulb residing in said socket, said flashlight bulb pointed away from said aperture; and a filament residing in said flashlight bulb, said filament positioned such that said first focus is located at one end of said filament.

13. A light reflector assembly comprising:

a housing with an exit aperture;

a light source residing in said housing;

a light reflector residing in said housing, said light reflector partially enclosing said light source and reflecting light from said light source towards said exit aperture in said housing, wherein the light reflector in the housing comprises:

an ellipsoidal reflector part shaped as a portion of an ellipsoid having a first focus and a second focus; and a spherical reflector part shaped as a zone of a sphere having a larger parallel edge and a smaller parallel edge, said smaller edge serving as an aperture, and said larger parallel edge connected to said ellipsoidal reflector part such that the spherical center of said spherical reflector part is also said first focus of said ellipsoidal reflector part;

a curvilinear reflector part coupled to the rim of said exit aperture in said housing, whereby said curvilinear reflector part is shaped to limit the angle of light shining out of said exit aperture;

a socket inserted into a rectangular opening in said ellipsoidal reflector part, said rectangular opening slightly offset in one direction from the axis of revolution of said ellipsoidal reflector part; and a cylindrical bulb inserted into said socket, said cylindrical bulb comprising a helical filament, wherein said socket and said cylindrical bulb are positioned in said slightly offset rectangular opening such that said first focus is located halfway along the length of said filament and at the perimeter of said helical filament.

14. The light reflector assembly of claim 13 wherein the inside of said ellipsoidal reflector part is divided circumferentially and radially into small trapezoidal facets that are curved.

15. The light reflector assembly of claim 13 wherein the insides of said ellipsoidal reflector part and said curvilinear reflector part are coated with multiple thin-film layers of different dielectric materials.

16. The light reflector assembly of claim 15 wherein said housing further comprises:

an intake vent;

an outflow vent;

a filter covering said intake vent; and a fan, said fan sucking air into said housing through said filter and said intake vent, and across said ellipsoidal reflector part.

* * * * *